United States Patent [19]

Brauer

[11] 4,369,645

[45] Jan. 25, 1983

[54] METHOD AND APPARATUS FOR COOLING WIRE ROD

[75] Inventor: Hans Brauer, Leichlingen, Fed. Rep. of Germany

[73] Assignee: Kocks Technik GmbH & Company, Hilden, Fed. Rep. of Germany

[21] Appl. No.: 162,954

[22] Filed: Jun. 25, 1980

[51] Int. Cl.[3] ..... B21B 43/00; B21B 45/02; C21D 1/62; C21D 9/52

[52] U.S. Cl. ..... 72/201; 148/12 B; 148/156; 266/112

[58] Field of Search ..... 72/201; 140/2; 148/12 B, 153, 156; 266/106, 112, 113, 107; 62/63, 64

[56] References Cited

U.S. PATENT DOCUMENTS

| | | | |
|---|---|---|---|
| 2,756,169 | 7/1956 | Corson et al. | 148/156 X |
| 3,011,928 | 12/1961 | Kopec et al. | 148/156 |
| 3,231,432 | 1/1966 | McLean et al. | 266/111 X |
| 3,557,438 | 1/1971 | Sieger | 140/2 X |
| 3,735,966 | 5/1973 | Hoffmann . | |
| 4,000,625 | 1/1977 | Beerens et al. | 72/201 X |
| 4,011,110 | 3/1977 | Bockenhoff et al. | 148/12 B |
| 4,024,745 | 5/1977 | Karlberger | 72/201 |
| 4,310,031 | 1/1982 | Appel et al. | 140/2 |

FOREIGN PATENT DOCUMENTS

| | | | |
|---|---|---|---|
| 37002 | 9/1886 | Fed. Rep. of Germany | 266/112 |
| 81919 | 7/1895 | Fed. Rep. of Germany . | |
| 620242 | 10/1935 | Fed. Rep. of Germany . | |
| 1071315 | 6/1967 | United Kingdom | 72/201 |
| 2029456 | 3/1980 | United Kingdom . | |

*Primary Examiner*—Ervin M. Combs

*Attorney, Agent, or Firm*—Buell, Blenko, Ziesenheim & Beck

[57] ABSTRACT

A method and apparatus are provided for cooling wire rod and wire in which wire rod and wire leaving the last roll block of a finishing mill is delivered to a first portion of a cooling path for the cooling of wire or wire which slopes downwardly from a likewise inclined finishing block at an angle $\alpha$ of at least 3° so that the wire rod or wire is subject to little or no compressive stress due to the friction between the wire rod or wire and the tube through which the latter passes in order to be subjected to cooling liquid. The wire rod or wire can be placed under tension if the angle of slope $\alpha$ is sufficiently large and, in an extreme case the first portion of the cooling path can decent vertically. A loop layer receives the wire rod or wire from the first portion and deposits the wire rod or wire in overlapping loops on conveying means where the wire rod or wire is air-cooled. The avoidance or minimizing of compressive stresses in the first cooling section makes the wire rod or wire less prone to buckle.

8 Claims, 8 Drawing Figures

L
α
1
2
3
4
5
6 h = g·t²/2

α ≅ 3°

α = φ

METHOD AND APPARATUS FOR COOLING WIRE ROD

This invention relates to methods and apparatus for cooling wire rod and particularly to a novel cooling path in which, following the last rolling stand of a finishing mill, the elongated wire is subject to a cooling liquid in a tubular first portion of the cooling path and then to air cooling in an overlapping coiled loop condition.

The invention broadly stated, relates to a cooling path for the cooling of hot-rolled wire rod or wire, in which there is provided beyond the last rolling stand of a finishing block a tubular, first portion of the cooling path which subjects the elongated wire to cooling liquid. A loop laying device is generally provided downstream of a cooling path portion of this kind and deposits the wire in overlapping loops onto a conveying means, such as an endless conveyor belt or conveyor rollers, acting as a second portion of the cooling path where the individual loops of wire, overlapping one another, are conveyed away and thereby further cooled by air.

In known cooling paths of this kind, the first portion of the cooling path either extends horizontally between the finishing block and loop laying device or it slopes upwardly from the delivery end of the finishing block towards the loop laying device.

These prior art known types of construction have the disadvantages that the wire, which is still in a hot state from the rolling operation and is thus of only low strength, is subjected to a relatively high compressive stress or approximately 0.07 to 0.1 kp/mm$^2$. This compressive stress is produced by the friction between the wire and the guide tube of the water-cooling path, the friction factor being approximately 0.2 to 0.3, and the length of the first portion of the cooling path generally being approximately 30 meters. There is a considerable risk of buckling as a result of this compressive stress, particularly in the case of high rolling speeds. If the wire rod or wire should buckle, it drags within the guide tubes of the first portion of the cooling path and can even jam in an extreme case. The wire rod or wire is damaged and, if it has jammed, can only be removed from the guide tubes at considerable expense which, of course, involves a long shutdown period.

An object of the invention is to provide a cooling path in which the wire is less prone to buckling even at high run-through speeds.

In accordance with the invention, there is provided a cooling path for the cooling of hot-rolled wire rod or wire, in which there is provided beyond the last rolling stand of a finishing block a tubular, first portion of the cooling path which subjects the elongated wire rod or wire to cooling liquid and which, contrary to prior art practices, descends from the finishing block.

Thus, the compressive stresses in the longitudinal direction of the wire rod or wire can be reduced to a considerable extent and can even be entirely eliminated. Furthermore, it is possible to subject the wire to a corresponding tensile stress which is so small that it cannot break the wire although it maintains the wire in a taut state. Thus, a cooling path of the type in accordance with the invention is particularly operationally reliable and is especially suitable for high rolling speeds.

The run-through axis of the finishing roll block preferably slopes downwardly and thus has the substantial advantage that the direction of movement of the wire no longer needs to be changed at the location where the wire has already reached a high run-through speed, the change in the direction of movement being effected upstream of the finishing block, that is to say, at a location where the run-through speed is substantially lower and is, for example, approximately 10 to 12 meters per second.

In a preferred embodiment of the invention, the first portion of the cooling path slopes downwardly with an angle of slope equal to or greater than 3 degrees. With an angle of slope of, for example, 6 degrees, the compressive stress is only 0.044 kp/mm$^2$ with a friction factor of 0.3 and thus generally lies below the stress which could cause buckling of the wire.

If it is desired to eliminate this slight residual compressive stress, it is possible to increase the angle of slope to an extent that the tangent of the angle of slope is equal to the tangent of the angle of friction or equal to the friction factor. However, with the great length of the first portion of the cooling path, this would mean that there would be a difference in height of approximately 12 meters between the finishing roll block and the loop laying device, which might be precluded by local conditions but which would otherwise be very advantageous.

In an extreme case, the angle of slope of the first portion of the cooling path is approximately 90 degrees. This, of course, presupposes that local conditions permit the resultant great difference in height between the finishing block and the loop laying device. The finishing roll block would then have to be disposed at a great height, this being quite conceivable in view of the generally known continuous casting plants which also are of considerable height. In a cooling path of this construction, the wire rod or wire would even be subjected to a tensile stress which would be caused by the weight of the wire rod or wire and which would ensure that the wire rod or wire passes through the first portion of the cooling path in a satisfactory manner without being over-stressed and broken.

A further embodiment of the invention can reside in the fact that the course of the first portion of the cooling path corresponds to the trajectory of the wire. Such a trajectory refers to that curve which would be described by an unbraked, free-falling length of wire rod or wire emerging at rolling speed and which would correspond to the trajectory of a projectile. In this embodiment neither a tensile stress nor a compressive stress is exerted on the wire rod or wire.

The trajectory and thus the construction of the water-cooling path can also be determined, although, of course, this embodiment is only suitable in cases in which the delivery speed of the work material remains constant at the predetermined value. On the other hand however, there is the advantage that the compressive stress in the wire rod or wire can be kept at zero when there is a relatively small difference between the height of the finishing block and the height of the loop laying device.

The prior art and the invention are further described, by way of example, with reference to the drawings in which.

Figures 1, 2, 3, 4, 5:
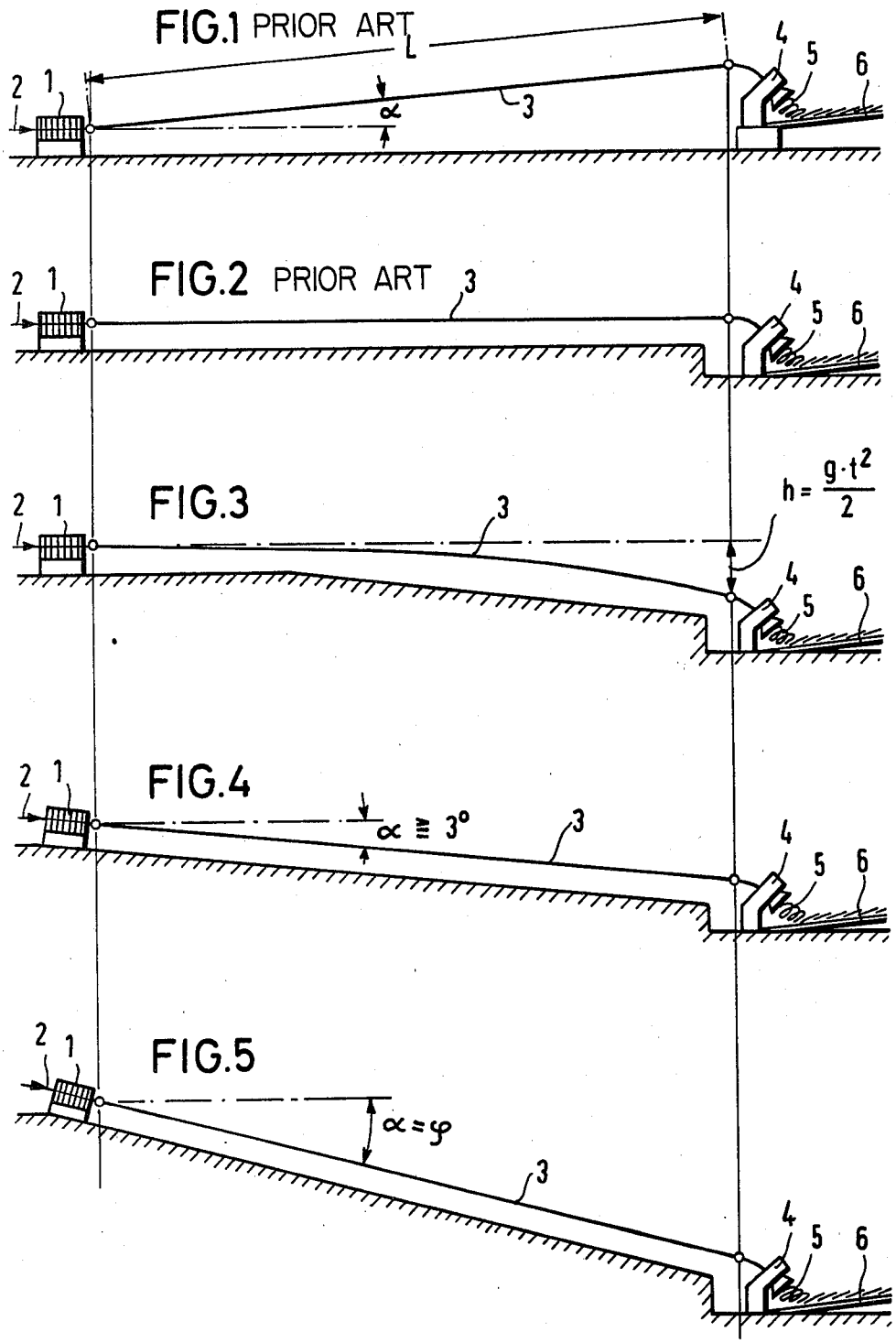
FIG.1 PRIOR ART
FIG.2 PRIOR ART
FIGS. 1 and 2 are diagrammatic elevations of two known cooling paths in which the first portion of the cooling path slopes upwardly and extends horizontally respectively.
FIGS. 3 to 6 are similar diagrammatic elevations of three cooling paths in accordance with the invention in which the first portion of the cooling path slopes downwardly.

Referring to FIG. 1, the wire 2 coming from rolling blocks (not illustrated) enters a finishing block 1 disposed therebeyond. The entry velocity is, for example, approximately 10 to 12 meters per second. Owing to the elongation of the wire rod or wire effected during its deformation, the wire rod 2 is delivered from the finishing roll block 1 at a velocity in excess of 50 meters per second and thus runs at this velocity through a first portion 3 of the cooling path having the length L of approximately 30 meters. At the end of the first portion 3 of the cooling path, the wire 2 enters a loop laying device 4 of known construction by which the wire is deposited in the form of loops 5 overlapping one another, onto a conveying means 6.

In the embodiment of FIG. 1, the first portion of the cooling path slopes upwardly from the finishing block 1 to the loop laying device at an angle $\alpha$ of slope. In this known construction, the finishing block 1 has a horizontal run-through axis, so that the run-through direction of the wire rod has to be corrected by the angle $\alpha$ shortly beyond the last rolling stand of the finishing block 1. The friction occurring in the first portion 3 of the cooling path also has to be taken into account, so that the total compressive stress occurring in the wire is calculated as follows:

$$\sigma_D=\gamma\cdot L\cdot\tan(\alpha+\rho)\cdot 10^{-3}$$

in which $\sigma_D$ represents the compressive stress in kiloponds per square millimeter, $\gamma$ represents the specific gravity of the wire rod, L represents the length of the cooling path, and $\alpha$ represents the angle of slope. $\psi$ is the angle of friction whose tangent is approximately 0.3, this being equivalent to the friction factor. The angle $\alpha$ of slope is approximately 6 degrees.

The embodiment of FIG. 2, which is also of known construction, subjects the wire rod to a smaller compressive stress which, however, is still too great, although the angle $\alpha$ of slope is zero owing to the horizontal arrangement of the first portion of the cooling path. However, a considerable friction factor still causes the compressive stress which is calculated from the following formula:

$$\sigma_D=\gamma\cdot L\cdot\tan\psi\cdot 10^{-3}$$

FIG. 3 shows an embodiment in accordance with the invention in which the compressive stress in the wire rod is zero. The downward slope of the first portion 3 of the cooling path is clearly shown, as well as the curvature there thereof corresponding to the trajectory of the wire 2. The difference in height in the region of the loop forming device is $h=\frac{1}{2}gt^2$, g being the acceleration due to gravity, and t being the time in seconds which an elemental length of wire rod under consideration needs to pass through the first portion 3 of the cooling path at the speed at which it is delivered from the last rolling stand. The individual points on the trajectory are calculated by the same formula, the time t being different in each case.

FIG. 4 shows a cooling path in which the first portion 3 of the cooling path slopes relative to the horizontal by an angle $\alpha$ equal to or greater than 3 degrees. While the slope of the finishing block 1 in the embodiment of FIG. 3 is very small and is virtually zero, it is clearly shown in the embodiment of FIG. 4 and corresponds to the angle $\alpha$ of the slope. This becomes negative, so that the following formula is obtained for calculating the compressive stress in the wire:

$$\sigma_D=\gamma\cdot L\cdot\tan(-\alpha+\psi)\cdot 10^{-3}$$

The residual compressive stress to be calculated from this formula is negligible.

This compressive stress $\sigma_D$ is zero in the embodiment of FIG. 5, that is to say, when the angle $\alpha$ of slope is equal to the friction angle $\psi$.

Figure 6:
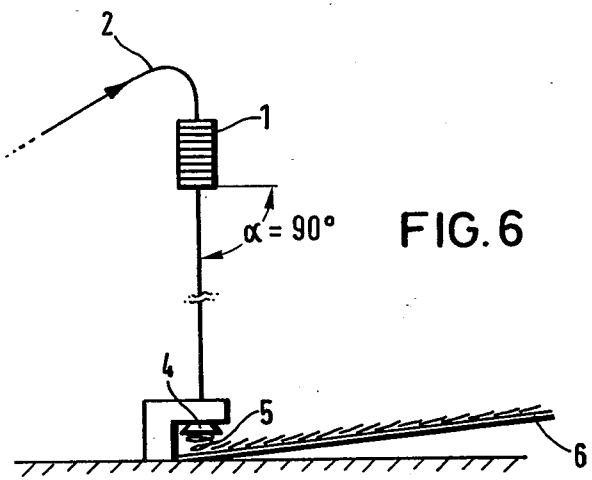

The angle $\alpha$ of slope is 90 degrees in the further embodiment of the invention shown in FIG. 6, thus resulting in a negative compressive stress, that is to say, a tensil stress $\sigma_Z$ which is calculated by the following formula:

$$\sigma_Z=\gamma\cdot L\cdot 10^{-3}$$

Figure 7:
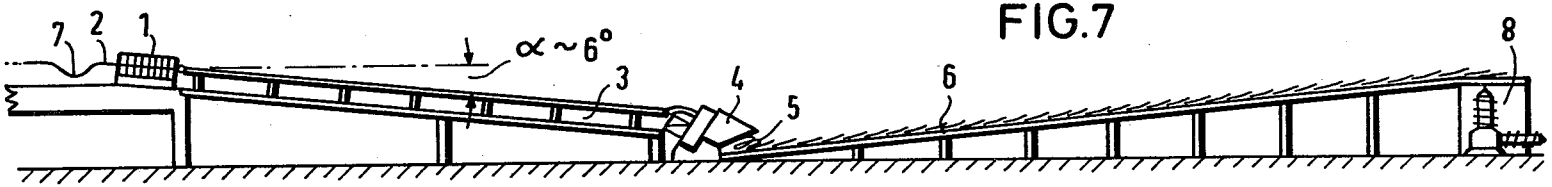
FIG. 7 is a more detailed illustration of the embodiment of FIG. 4.

FIG. 7 clearly shows that the wire rod 2 forms a hanging loop 7 upstream of the finishing block 1, thus ensuring that the wire rod 2 enters the finishing block free from tensile and compressive stresses. The reference symbols correspond to those used in the Figures described above. FIG. 7 constitutes an embodiment of the invention which is preferred at the present time, and also shows the second portion of the cooling path with its conveyor element 6, and a bundle-forming station 8 where the cooled loops 5 are collected to form a bundle.

Figure 8:
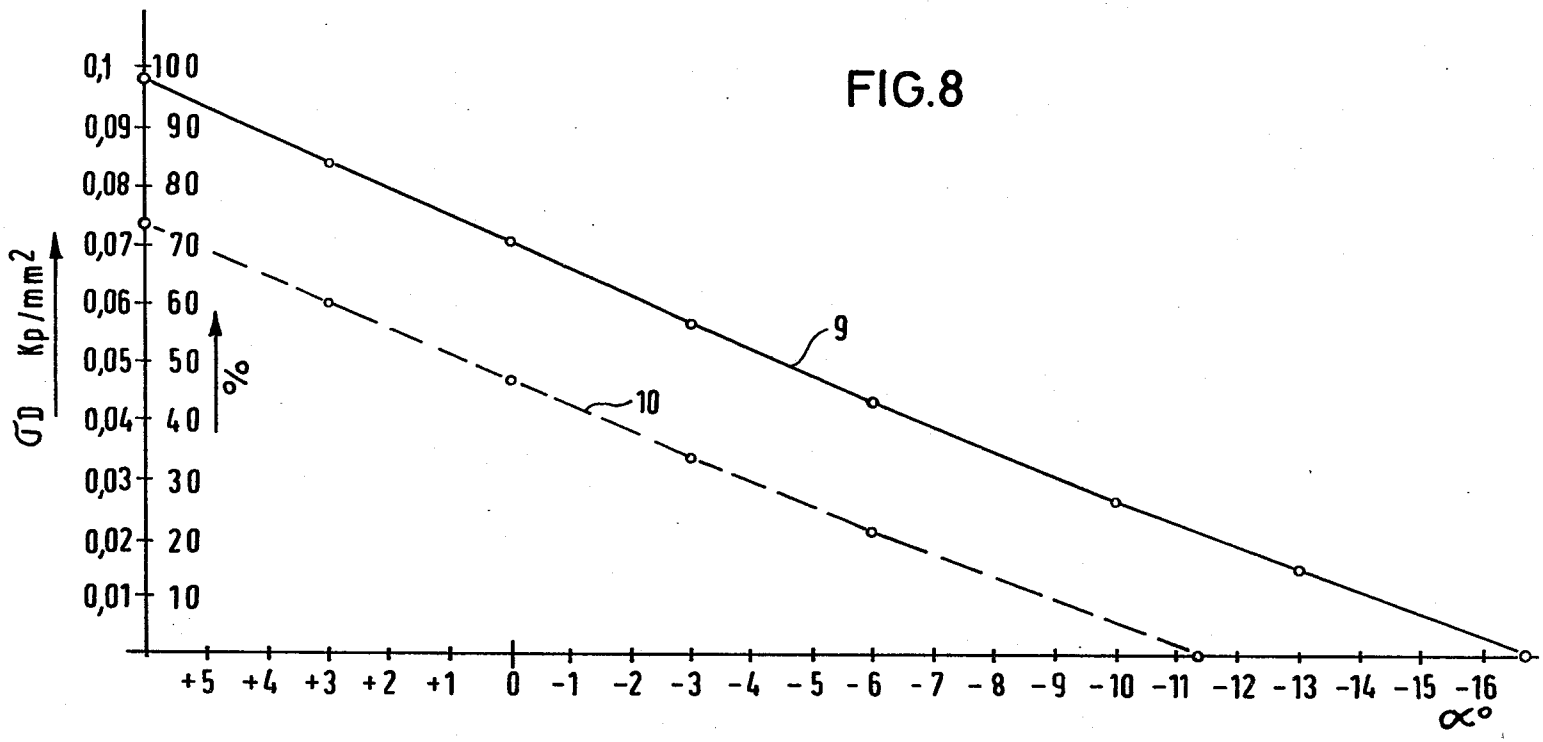
FIG. 8 is a graph in which the compressive stress in the wire is plotted against the angle of slope.

The graph of FIG. 8 shows the compressive stress $\sigma_D$ in the wire 2 plotted against the angle $\alpha$ of slope. The various angles of slope are plotted along the abscissa, whereas the coordinate shows the stress values $\sigma_D$ in kiloponds per square millimeter and in percentages. The curve 9 shown by a solid line applies to the tangent of the friction angle $\psi$ (that is to say, for a friction factor) of 0.3, whereas the second curve 10 shown by a broken line applies to a friction factor of 0.2.

In the foregoing specification I have set out certain preferred embodiments and practices of my invention, however, it will be understood that this invention may be otherwise embodied within the scope of the following claims.

I claim:

1. In a cooling section for cooling hot-rolled wire, in which a tubular initial cooling section segment that plays a cooling liquid on the stretched wire is provided beyond a last roll stand of a multiple stand finishing roll block, each of said roll stands defining a work passage axis between working rolls thereof, the said cooling section segment sloping downwardly from said last roll stand, the improvement comprising that, in addition to the initial cooling section segment, said passage axes of all roll stands making up the finishing block are also inclined downward in line with respect to the horizontal by substantially the same angle of inclination as the following cooling section segment.

2. Cooling section according to claim 1, in which the initial cooling section segment follows an arc-like, downward-inclined curve from the finishing block, at least initially, characterized in that the arc-like, downward-inclined curve corresponds to the trajectory of the wire over the entire length of the initial cooling section segment.

3. A cooling section as claimed in claim 1, in which both the passage axis of the finishing roll block slopes downwardly relative to the horizontal and the first portion of the cooling path slopes downwardly at an angle of at least 3 degrees.

4. A cooling section as claimed in claim 2, in which the first portion of the cooling path corresponds to the normal gravitational trajectory of the wire rod or wire.

5. A cooling section as claimed in 1 in which both the passage axes of the roll stands of the finishing roll block and said tubular segment of the cooling section slope downwardly at an angle of about 6 degrees.

6. The method of cooling hot-rolled wire rod and wire comprising the steps of:

a. feeding said wire rod and wire downwardly from a last roll stand of a multiple stand finishing roll block, each of said stands defining a work passage axis between working rolls thereof, into a tubular downwardly sloping cooling portion wherein said passage axes of all roll stands making up the finishing block and the tubular sloping portion are inclined downwardly with respect to the horizontal by substantially the same angle of inclination; and b. at least partially cooling said wire rod and wire with liquid coolant in said downwardly sloping tubular portion.

7. The method as claimed in claim 6 wherein the angle of inclination is at least 3 degrees.

8. The method as claimed in claim 6 wherein the angle of inclination is about 6 degrees.

* * * * *